United States Patent [19]

Gorin

[11] 4,138,223

[45] Feb. 6, 1979

[54] MANUFACTURE OF PELLETS FROM COAL LIQUEFACTION PRODUCTS

[75] Inventor: Everett Gorin, San Rafael, Calif.

[73] Assignee: Continental Oil Company, Stamford, Conn.

[21] Appl. No.: 861,082

[22] Filed: Dec. 15, 1977

[51] Int. Cl.[2] ..... C10L 5/00; C10L 5/16; C10G 1/00

[52] U.S. Cl. ..... 44/10 C; 44/23; 44/24; 201/5; 208/8

[58] Field of Search ..... 44/1 F, 23, 24, 10 C, 44/10 R; 201/5, 6; 208/8

[56] References Cited

U.S. PATENT DOCUMENTS

| | | | |
|---|---|---|---|
| 1,793,014 | 2/1931 | Rodgers | 44/10 C |
| 2,736,690 | 2/1956 | Mattox et al. | 44/23 X |
| 3,562,783 | 2/1971 | Gorin | 208/8 X |
| 3,748,254 | 7/1973 | Gorin | 208/8 |
| 3,920,418 | 11/1975 | Rice | 208/8 X |
| 4,008,054 | 2/1977 | Gorin et al. | 44/10 R |
| 4,030,982 | 6/1977 | Gorin et al. | 201/6 |

*Primary Examiner*—Carl Dees

*Attorney, Agent, or Firm*—D. Leigh Fowler; F. Lindsey Scott; William A. Mikesell

[57] ABSTRACT

The effluent slurry product from a coal liquefaction reactor is split into two streams. The first stream is subjected to vacuum distillation to produce a vacuum bottoms. The second stream is mixed with particulate char to form a solids-enriched slurry feedstock to a low temperature carbonization plant. The char made in this plant, plus the vacuum bottoms from the first stream, forms a pelletizable composition which serves as a feedstock to a pelletizing plant. By virtue of the foregoing procedure, a reduction of the order of 30 percent in size of the pelletizing plant is effected, as compared to sending to the pelletizing plant all the vacuum bottoms obtainable from the entire coal liquefaction effluent slurry product; yet about the same total weight of pellets is made.

1 Claim, 1 Drawing Figure

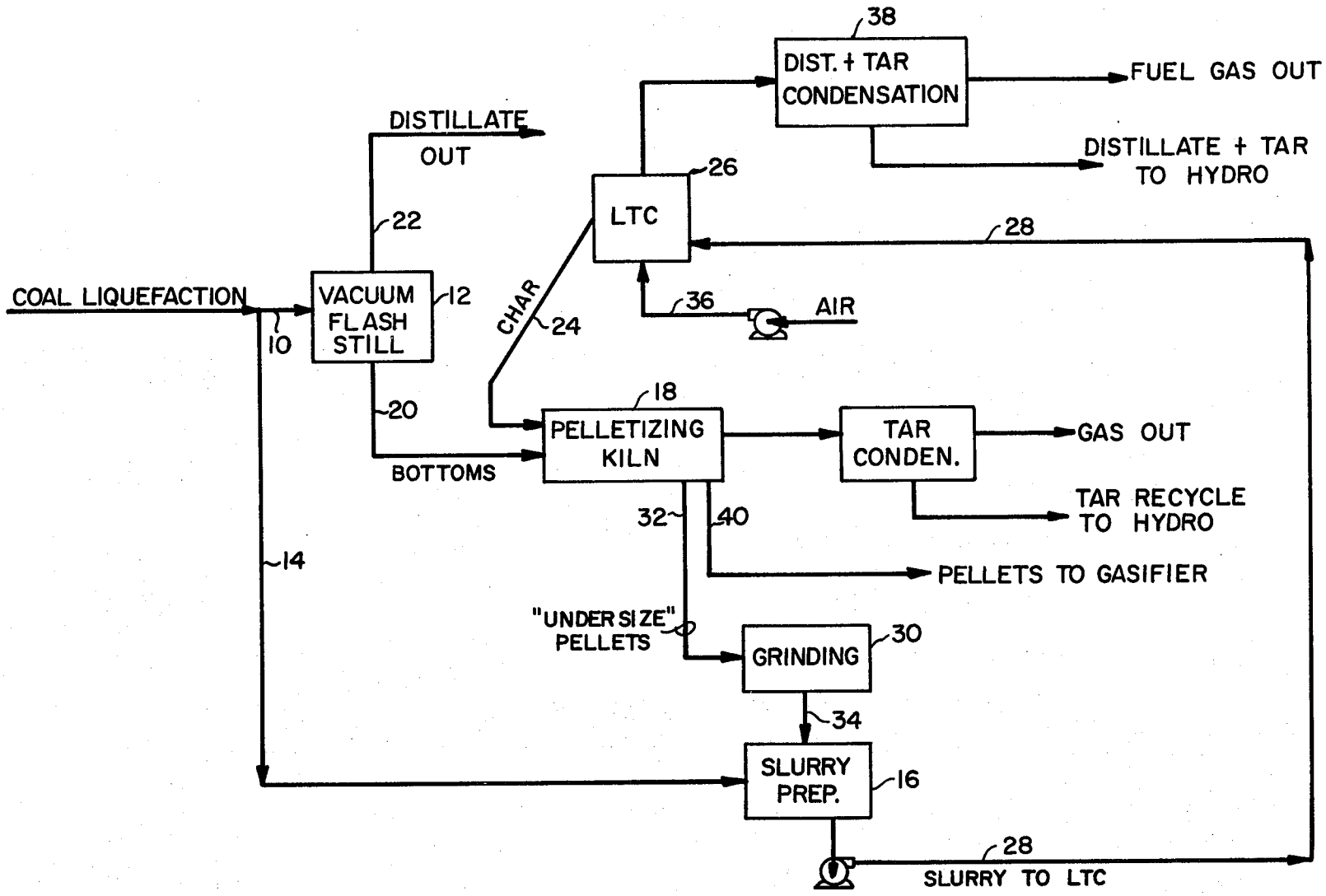
FUEL GAS OUT
DISTILLATE + TAR TO HYDRO
DIST. + TAR CONDENSATION
38
28
AIR
36
26
LTC
24
CHAR
DISTILLATE OUT
22
VACUUM FLASH STILL
12
20
BOTTOMS
10
14
COAL LIQUEFACTION
GAS OUT
TAR RECYCLE TO HYDRO
TAR CONDEN.
PELLETS TO GASIFIER
40
18
PELLETIZING KILN
32
"UNDERSIZE" PELLETS
30
GRINDING
34
SLURRY PREP.
16
28
SLURRY TO LTC

MANUFACTURE OF PELLETS FROM COAL LIQUEFACTION PRODUCTS

This invention relates to an improvement in coal liquefaction processes, and, more particularly, to the production of pellets suitable for use as feedstock to fixed or gravitating bed gasifiers.

In particular, the invention relates to coal liquefaction processes wherein a solvent (hereinafter sometimes called "liquefaction solvent") is present during the liquefaction of the coal. Liquefaction may be achieved by hydrogenation, depolymerization, extraction, etc. The liquefaction solvent, which is generally coal derived, may function as solvent for the coal, or for the products, or both. It may also play a reactive role, for instance, in the depolymerization and hydrogenation of the coal molecules. Liquefaction may also be achieved with or without a catalyst, and with or without molecular (gaseous) hydrogen, in addition to the liquefaction solvent.

The effluent slurry product of a coal liquefaction process such as has just been described contains extract which comprises both distillable and non-distillable fractions; a distillable but generally high boiling liquefaction solvent; and undissolved ash-containing carbonceous solids, a substantial portion of which is suspended in the solution because of the micron and sub-micron size of the solids. To obtain clean liquid fuels from such a slurry product, vacuum distillation may be resorted to, either with or without prior separation of solids. It is obviously less costly to subject the entire slurry to vacuum distillation, leaving a solids-laden bottoms fraction which is suitable for making gas if in proper form, such as non-caking pellets.

A method which is suitable for the manufacture of pellets from the solids-laden vacuum bottoms fraction of a coal liquefaction effluent slurry has been described in numerous patents of the assignee of the present invention. They include the following U.S. Pat. Nos.: 3,562,783; 3,748,254; 4,008,054; and 4,030,982. The preferred system set forth in these patents for making the pellets involves the use of a rotary kiln which is adapted to rotate about its slightly inclined horizontal axis. The kiln serves to tumble hot recycle char (devolatilized carbonaceous solids) and liquid binder together as they advance through the kiln. The temperature of the char as introduced into the kiln is selected so as to maintain the temperature of the tumbling mixture adiabatically above 200° C., or above 350° C. if carbonizing conditions are desired. The size of the resulting pellets is determined primarily by the ratio of liquids to solids in the kiln. In general, in order to attain the desired pelletizing conditions in the kiln, particularly temperature and liquid-to-solid ratio, prohibitive amounts of hot char are required, resulting in uneconomically sized plants. The primary object of this invention is to significantly reduce the char requirements, and thus the size of the pelletizing plant.

SUMMARY OF THE INVENTION

In accordance with my invention, the effluent slurry product from the coal liquefaction reactor is split into two streams. The first stream is subjected to vacuum distillation to produce a vacuum bottoms. The second stream is mixed with particulate char and used as a solids-enriched slurry feedstock to a low temperature carbonization plant. The char made in this plant and the vacuum bottoms from the first stream form a pelletizable composition which serves as the feedstock to a pelletizing plant. Such a procedure effects a reduction in the pelletizing plant size of about 30 percent, as compared to sending to the pelletizing plant all the vacuum bottoms obtainable from the entire coal liquefaction effluent slurry product. Yet the yield of pellets is about the same.

For a better understanding of my invention, its objects, and advantages, reference should be had to the following description of the preferred embodiment of the present invention and to the accompanying drawing which illustrates schematically the preferred embodiment.

Referring to the drawing, the feedstock is coal liquefaction effluent consisting essentially of coal extract which contains both distillable and non-distillable fractions; a high boiling coal liquefaction solvent; and undissolved ash-containing carbonaceous solids, largely suspended in the solution of extract in the solvent. The feedstock is split into two streams, the first passing through a conduit 10 to a Vacuum Flash Still 12; the second passing through a conduit 14 to a Slurry Preparation plant 16. The relative sizes of the two streams is dictated by the ratio of liquid-to-solid required to make the desired pellets in a Pelletizing Kiln 18.

The liquid fed to the Pelletizing Kiln 18 through a conduit 20 is the solids-laden bottoms product from the Vacuum Flash Still 12. A clean distillate product is recovered through a conduit 22. The solid fed to the Pelletizing Kiln 18 through a conduit 24 is the hot finely divided char produced in a low temperature carbonization (LTC) plant 26. A preheater (not shown) may be required to further heat the fresh char to the temperature required in the kiln 18. The feedstock for the LTC plant is slurry conducted by a conduit 28 from the Slurry Preparation plant 16. The slurry consists essentially of the split stream of coal liquefaction effluent to which has been added finely ground undersize pellets from the kiln 18. A grinding plant 30 is connected by conduits 32 and 34 to the kiln and slurry preparation plant, respectively. Heat is supplied to the LTC plant by partial combustion of the slurry with air introduced into the plant by a conduit. Distillables and tar are condensed from the off-gases of the LTC plant in a condenser 38 to yield fuel gas, distillate and tar suitable for upgrading by hydrogenation.

Pellets of a size suitable as feed to a downwardly moving bed in a fixed bed gasifier are formed in the rotating kiln 18. Those above a prescribed size, e.g. 1 cm. are screened from the undersize and sent to the gasifier through a conduit 40. Any tar is recovered in a condenser 42.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a coal liquefaction process which employs a liquefaction solvent, wherein an effluent slurry product is recovered which contains a solution of coal liquefaction products in said liquefaction solvent, and finely divided, undissolved solids suspended in said solution, the improvement which comprises:

(a) splitting said effluent slurry product into first and second streams;

(b) subjecting the first stream to vacuum distillation to yield an overhead distillate fraction and a solids-laden bottoms fraction;

(c) mixing the second stream with particulate char, to form a slurry;

(d) subjecting the slurry from step (c) to low temperature carbonization to form char and vaporous products;

(e) forming a pelletizable composition out of the solids-laden bottoms fraction from step (b) and the char from step (d);

(f) pelletizing said pelletizable composition from step (e); and (g) recovering pellets from step (f).

* * * * *